US011735387B2

(12) United States Patent
Kamiyama et al.

(10) Patent No.: US 11,735,387 B2
(45) Date of Patent: Aug. 22, 2023

(54) ELECTROMAGNETIC CONTACTOR

(71) Applicant: Mitsubishi Electric Corporation, Tokyo (JP)

(72) Inventors: Tomoyuki Kamiyama, Tokyo (JP); Katsutoshi Ikarashi, Tokyo (JP); Kazuki Takahashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 58 days.

(21) Appl. No.: 17/632,308

(22) PCT Filed: Oct. 5, 2020

(86) PCT No.: PCT/JP2020/037725
§ 371 (c)(1),
(2) Date: Feb. 2, 2022

(87) PCT Pub. No.: WO2021/075295
PCT Pub. Date: Apr. 22, 2021

(65) Prior Publication Data

US 2022/0293372 A1 Sep. 15, 2022

(30) Foreign Application Priority Data

Oct. 17, 2019 (JP) ..... 2019-190199

(51) Int. Cl.
*H01H 47/36* (2006.01)
*H01H 47/00* (2006.01)

(52) U.S. Cl.
CPC ..... *H01H 47/36* (2013.01); *H01H 47/002* (2013.01)

(58) Field of Classification Search
CPC ..... H01H 47/002; H01H 47/36
(Continued)

(56) References Cited

U.S. PATENT DOCUMENTS 5,737,172 A * 4/1998 Ohtsuka ..... H01H 47/325 361/187
2009/0080133 A1* 3/2009 Chaudhuri ..... H01H 47/223 361/152

(Continued)

FOREIGN PATENT DOCUMENTS

JP S61140015 A 6/1986
JP H0831288 A 2/1996

(Continued)

OTHER PUBLICATIONS

International Search Report (PCT/ISA/210) with English translation and Written Opinion KPCT/ISA/237) dated Dec. 8, 2020, by the Japan Patent Office as the International Searching Authority for International Application No. PCT/JP2020/037725.

*Primary Examiner* — Yemane Mehari
(74) *Attorney, Agent, or Firm* — Buchanan Ingersoll & Rooney PC

(57) ABSTRACT

A coil drive device energizes an operation coil to close an electromagnetic contactor. A rectifier outputs, to a power supply line, an input voltage obtained by full-wave rectification of an AC voltage supplied from a main power source. A controller controls on and off of a switching element connected to a power supply line in series with the operation coil. The controller controls a duty ratio that is an on period ratio of the switching element in each switching period in accordance with a value of a parameter calculated from a detected value of the input voltage, in at least a partial period after start of energization of the operation coil in response to a close command for the electromagnetic contactor.

12 Claims, 12 Drawing Sheets

(58) Field of Classification Search
USPC ..... 361/188
See application file for complete search history.

(56) References Cited

U.S. PATENT DOCUMENTS

| | | | |
|---|---|---|---|
| 2013/0114178 A1 | 5/2013 | Adachi et al. | |
| 2018/0218862 A1* | 8/2018 | Matsuo ..... | H01H 47/32 |

FOREIGN PATENT DOCUMENTS

| | | |
|---|---|---|
| JP | 2003032919 A | 1/2003 |
| JP | 2004186052 A | 7/2004 |
| JP | 2008060461 A | 3/2008 |
| JP | 2009076457 A | 4/2009 |
| JP | 2013101843 A | 5/2013 |
| WO | 2017159069 A1 | 9/2017 |

* cited by examiner

ELECTROMAGNETIC CONTACTOR

TECHNICAL FIELD

The present disclosure relates to an electromagnetic contactor.

BACKGROUND ART

In an electromagnetic contactor, typically, an operation coil that forms an electromagnet is energized to generate attraction force to attract a movable core to a fixed core, whereby contacts come into contact with each other to close an electric circuit.

As a driving device for the operation coil of an electromagnetic contactor, a configuration that performs switching control of a power supply voltage and applies the controlled power supply voltage to the coil is known. For example, WO 2017/159069 (PTL 1) discloses control to reduce the on/off time ratio (duty ratio) in switching control during the holding control after circuit close, compared with during the close circuit control of the operation coil; and control to suppress excessive coil current during the close circuit control, when an electric circuit is closed.

Specifically, in PTL 1, for coil current in the close circuit control, the duty ratio is controlled by PID control computation of a deviation of an actual value (moving average value) from a setting value in accordance with a predetermined change locus of coil current, and the attraction state of the movable core is detected based on this duty ratio. Thus, transition from the close circuit control to the holding control is accurately determined by detecting the attraction state of the movable core without using a position sensor or a timer, so that an excessive magnetic field due to occurrence of excessive coil current is prevented.

CITATION LIST

Patent Literature

PTL 1: WO 2017/159069

SUMMARY OF INVENTION

Technical Problem

However, in PTL 1, fast computation is required to control coil current in accordance with a predetermined change locus. As a result, higher specifications of a controller that performs computation may increase the production cost.

The present disclosure is made in order to solve such a problem. An object of the present disclosure is to suppress excessive coil current during close circuit control of an electromagnetic contactor with simple control that does not require a fast computational process.

Solution to Problem

According to an aspect of the present disclosure, an electromagnetic contactor includes first and second contacts, a mechanism to generate a biasing force for opening the first and second contacts, an operation coil, and a coil drive device. The operation coil generates an electromagnetic force for bringing the first and second contacts into contact with each other against the biasing force. The coil drive device supplies current for generating the electromagnetic force to the operation coil. The coil drive device includes a rectifier, a switching element, a voltage detector, and a controller. The rectifier outputs, to a power supply line, an input voltage obtained by full-wave rectification of an AC voltage supplied from an AC power source. The switching element is connected to the power supply line in series with the operation coil. The voltage detector detects the input voltage. The controller controls on and off of the switching element. The controller controls on and off of the switching element so as to control a duty ratio that is a ratio of an on period of the switching element in a predetermined switching period shorter than one cycle of the AC voltage. Further, the controller controls the duty ratio in accordance with a value of a first parameter indicating a magnitude of the input voltage that is calculated using a detected value of the voltage detector, in at least a partial period after start of energization of the operation coil in response to a close command for the electromagnetic contactor. When a calculation value of the first parameter is larger than a predetermined reference value, the duty ratio is set to a value lower than when the calculation value is equal to or smaller than the reference value.

Advantageous Effects of Invention

According to the present disclosure, simple control, i.e., control of the duty ratio of a switching element to reflect the magnitude of the input voltage, is performed in at least a partial period after start of energization of the operation coil in response to a close command to the electromagnetic contactor, whereby the duty ratio is reduced when the input voltage is large, and excessive coil current is suppressed.

DESCRIPTION OF EMBODIMENTS

Figure 1:
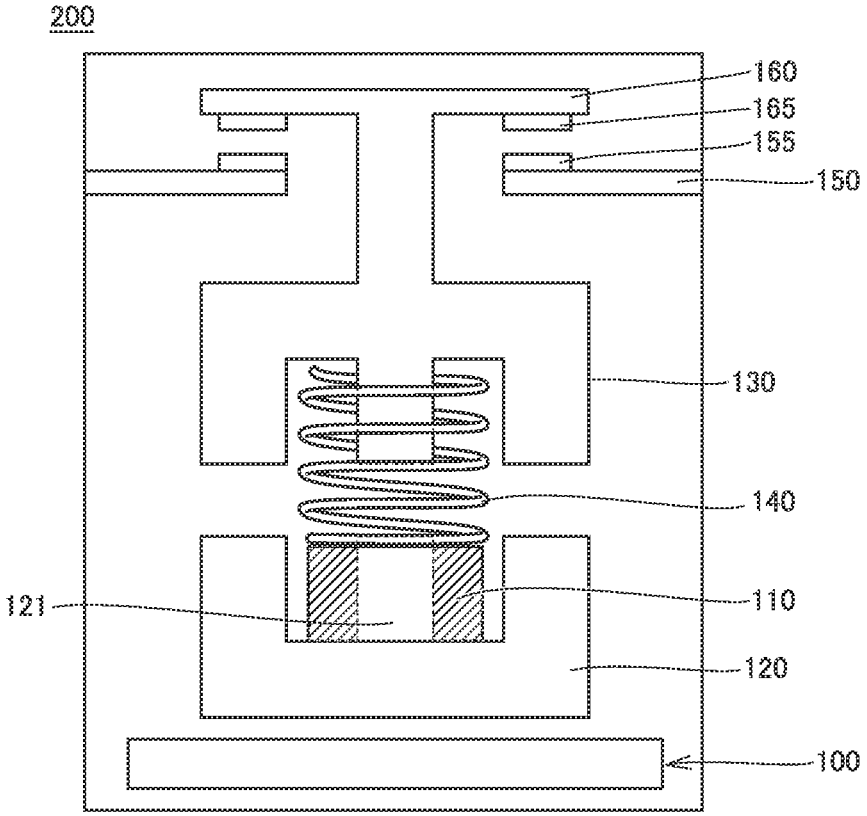
FIG. 1 is a conceptual cross-sectional view of an electromagnetic contactor according to the present embodiment.

Embodiments of the present disclosure will be described in detail below with reference to the drawings. In the following, like or corresponding parts in the drawings are denoted by like reference signs and a description thereof is basically not repeated.

First Embodiment

FIG. 1 is a conceptual cross-sectional view illustrating a configuration of an electromagnetic contactor according to a first embodiment. FIG. 1 shows a schematic cross-sectional view of an electromagnetic contactor in an open state of an electric circuit (during an open circuit).

Referring to FIG. 1, an electromagnetic contactor 200 includes a coil drive device 100, a coil 110, a fixed core 120, a movable core 130, a spring 140, a fixed terminal 150, a fixed contact 155, a movable terminal 160, and a movable contact 165.

Spring 140 is illustrated as an example of a mechanism for producing biasing force for separating fixed core 120 and movable core 130 (contacts) from each other, that is, biasing force for bringing electromagnetic contactor 200 into an open state.

Coil 110 is wound around a magnetic leg 121 of fixed core 120 and is supplied with coil current Ic by coil drive device 100 to generate an electromagnetic force to attract movable core 130. In the state in FIG. 1, coil current is not supplied and coil 110 does not generate an electromagnetic force. As a result, electromagnetic contactor 200 is in an open state.

Movable terminal 160 is coupled to movable core 130. Thus, when an electromagnetic force generated by coil 110 acts on movable core 130, movable terminal 160 moves integrally with movable core 130.

Fixed contact 155 and movable contact 165 are welded to fixed terminal 150 and movable terminal 160, respectively, at a position opposed to each other during an open circuit shown in FIG. 1.

Figure 2:
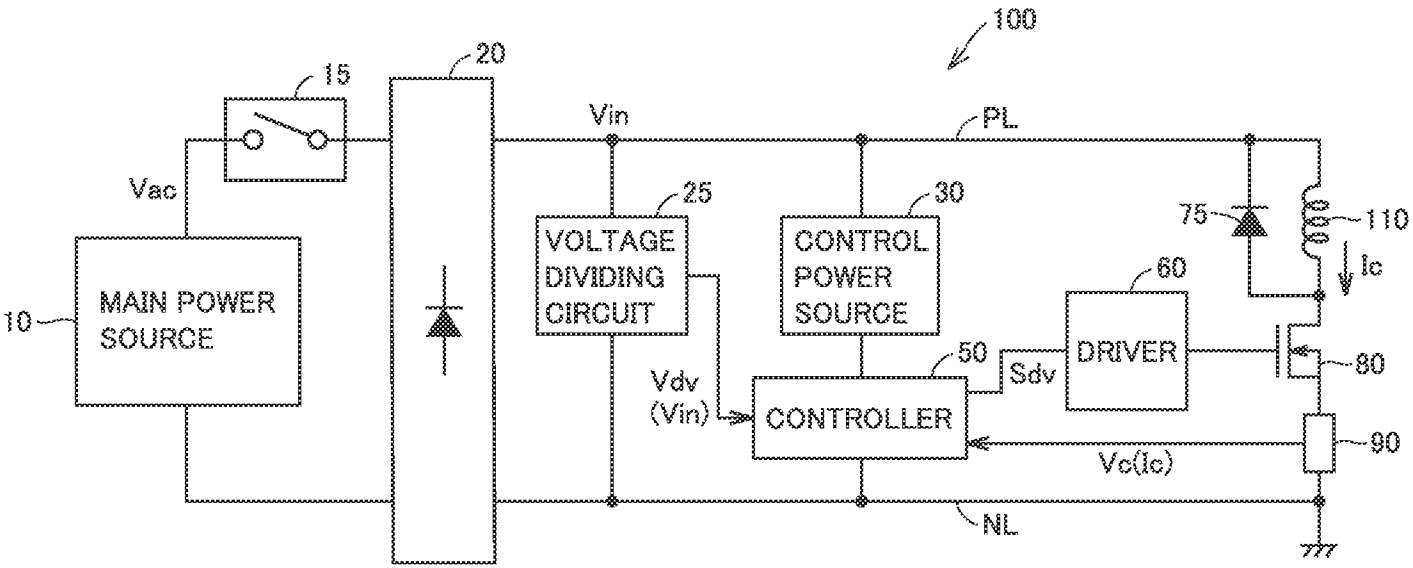
FIG. 2 is a block diagram illustrating a configuration of a coil drive device of the electromagnetic contactor according to a first embodiment.

FIG. 2 is a block diagram illustrating a configuration of the coil drive device of the electromagnetic contactor according to the first embodiment.

Referring to FIG. 2, coil drive device 100 of the electromagnetic contactor according to the first embodiment supplies coil current Ic to coil 110, which is an operation coil of the electromagnetic contactor, with power supply from a main power source 10.

Figure 3:
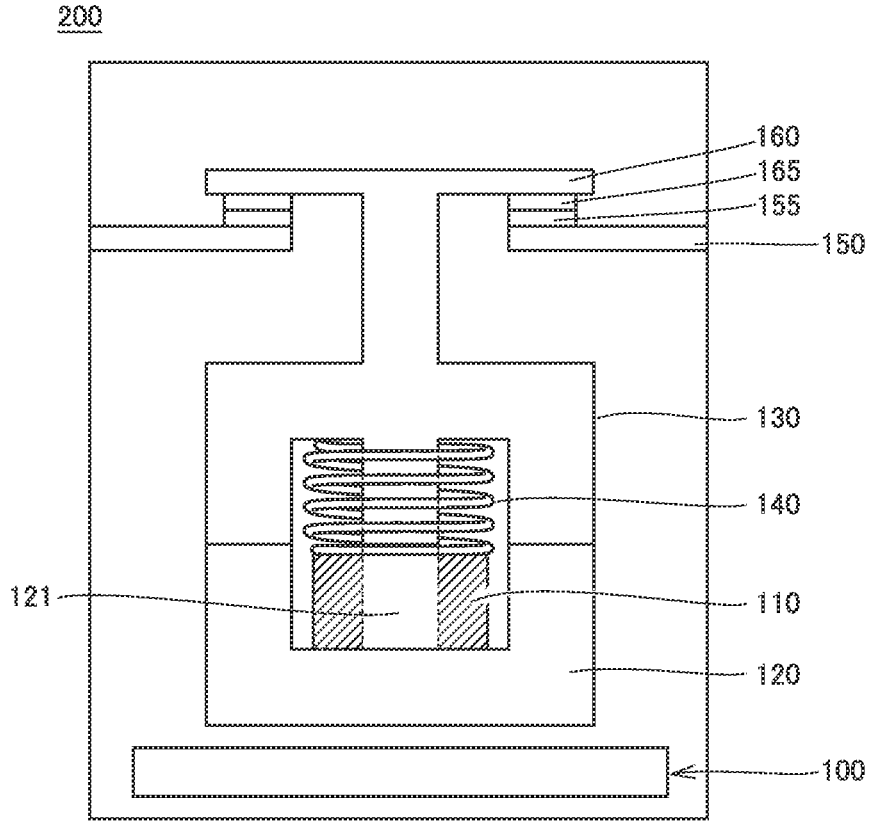
FIG. 3 is a conceptual cross-sectional view in a closed state of the electromagnetic contactor shown in FIG. 1.

FIG. 3 shows a schematic cross section in a closed state of an electric circuit (during a closed circuit) for the electromagnetic contactor shown in FIG. 1.

Referring to FIG. 3, with supply of coil current, coil 110 generates an electromagnetic force to cause movable core 130 to be attracted toward fixed core 120. When the attraction force (electromagnetic force) generated by coil 110 becomes larger than the biasing force by spring 140, spring 140 is compressed, and movable core 130 is attracted to fixed core 120. Thus, fixed core 120 and movable core 130 come into contact with each other, and fixed contact 155 and movable contact 165 come into contact with each other, whereby electromagnetic contactor 200 is closed. That is, in the electromagnetic contactor shown in FIG. 1 and FIG. 3, fixed contact 155 and movable contact 165 correspond to an embodiment of "first and second contacts".

The electromagnetic force generated by coil 110 increases with increase of coil current Ic supplied by coil drive device 100. In a state in which fixed core 120 and movable core 130 are separated, coil current is controlled such that the attraction force (electromagnetic force) as described above is generated from coil 110 to close electromagnetic contactor 200. After movable core 130 is attracted to fixed core 120, coil current need to be controlled to generate a necessary electromagnetic force in order to keep the attracted state.

In the close circuit operation of electromagnetic contactor 200, the attraction force acting on movable core 130 is equivalent to the one obtained by subtracting the biasing force by spring 140 from the electromagnetic force generated by coil 110. Therefore, if coil current Ic is excessively large, the attraction force is too large so that impact caused by movable core 130 attracted to fixed core 120 may be excessively large. If this impact damages movable core 130 or movable contact 165, or fixed core 120 or fixed contact 155, the damage may influence the service life of electromagnetic contactor 200. In this way, the control of coil current Ic by coil drive device 100 is important.

Referring to FIG. 2 again, coil drive device 100 includes a rectifier 20, a voltage dividing circuit 25, a control power source 30, a controller 50, a driver 60, a diode 75, a switching element 80, and a current detector 90.

Rectifier 20 is connected to main power source 10 through an operation switch 15. Main power source 10 is, for example, a commercial AC power source and outputs an AC voltage Vac having a predetermined frequency.

Rectifier 20 generates an input voltage Vin between a high voltage-side power supply line PL and a low voltage-side power supply line NL by full-wave rectification of AC voltage Vac from main power source 10. For example, rectifier 20 can be configured with a full-bridge circuit of diodes. Low voltage-side power supply line NL usually supplies a ground voltage, and therefore power supply line NL may hereinafter be referred to as ground line NL.

Voltage dividing circuit 25 generates a divided voltage Vdv of input voltage Vin. Divided voltage Vdv has a voltage value obtained by multiplying input voltage Vin by a certain voltage dividing ratio (less than 1.0). Control power source 30 converts input voltage Vin on power supply line PL into an operating power supply voltage (for example, 5 [V]) of controller 50.

Switching element 80 is connected in series with coil 110 between power supply line PL and ground line NL. Switching element 80 is configured with a semiconductor switching element capable of on/off control in response to an electrical signal input to its control electrode. Switching element 80 is typically a metal-oxide-semiconductor field-effect transistor (MOSFET).

In this configuration, when a positive voltage exceeding a threshold voltage is applied to the control electrode (for example, gate), switching element 80 turns into the on state in which current passes between a high voltage-side electrode (for example, drain) and a low voltage-side electrode (for example, source). Conversely, when the voltage of the control electrode with respect to the low voltage-side electrode (for example, gate-source voltage) is lower than the threshold voltage, switching element 80 turns into the off state in which the high voltage-side electrode is electrically cut off from the low voltage-side electrode.

Diode 75 is connected in parallel with coil 110. In an on period of switching element 80, coil current Ic flows from power supply line PL to ground line NL via coil 110 and switching element 80. On the other hand, in an off period of switching element 80, a circulating current path including coil 110 and diode 75 provides a path of coil current Ic. Current detector 90 is connected in series with coil 110. Current detector 90 is formed with, for example, a resistor element that produces a voltage drop in accordance with the magnitude of coil current Ic. Alternatively, unlike the illustration in FIG. 2, current detector 90 may be formed with a current sensor such as a Hall element arranged to detect passing current through coil 110.

Controller 50 may be configured with a microcontroller operating with power supply from control power source 30. Divided voltage Vdv from voltage dividing circuit 25 and a detected voltage Vc from current detector 90 are input to controller 50. As described above, since detected voltage Vc is proportional to coil current Ic, controller 50 can detect coil current Ic from detected voltage Vc. Controller 50 generates a control signal Sdv to control the on/off of switching element 80 by duty control described later.

In the configuration example in FIG. 1, coil 110 corresponds to an embodiment of "operation coil", voltage dividing circuit 25 corresponds to an embodiment of "voltage detector", and main power source 10 corresponds to an embodiment of "AC power source".

Figure 4:
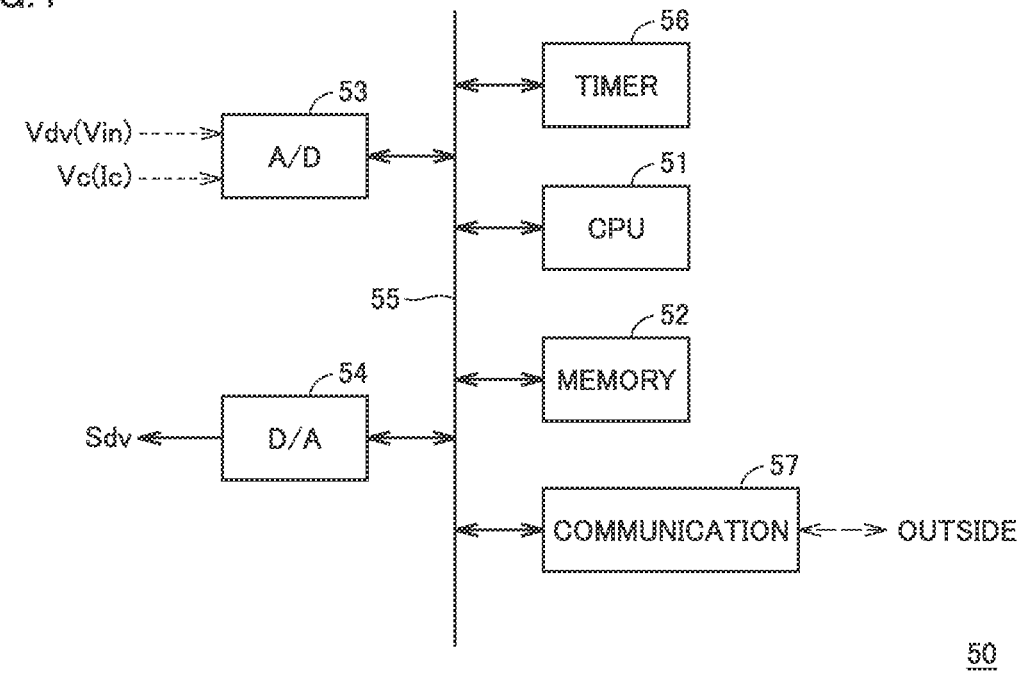
FIG. 4 is a block diagram illustrating an overall configuration of a controller shown in FIG. 2.

FIG. 4 shows a block diagram illustrating an overall configuration of controller 50.

Referring to FIG. 4, controller 50 includes a central processing unit (CPU) 51, a memory 52, an A/D converter 53, a D/A converter 54, a timer 56, and a communication unit 57. CPU 51, memory 52, A/D converter 53, D/A converter 54, timer 56, and communication unit 57 can exchange data with each other via an internal bus 55. Communication unit 57 is configured such that wireless communication or wired communication for exchanging data with the outside of controller 50 is performed.

Memory 52 is formed with a random access memory (RAM) and a read-only memory (ROM) for storing programs and data. Timer 56 is formed with an oscillator, for example, and generates a clock signal having a certain frequency for counting time.

A/D converter 53 and D/A converter 54 have a function as an input/output (I/O) circuit, and A/D converter 54 converts an analog voltage from the outside of controller 50 into a digital signal. For example, A/D converter 54 converts divided voltage Vdv (voltage dividing circuit 25) and detected voltage Vc (current detector 90) into digital data.

CPU 51 executes a computation process using a program and data stored in memory 52, input voltage Vin detected from divided voltage Vdv, and coil current Ic obtained from detected voltage Vc. In the present embodiment, controller 50 performs duty control for controlling current supply to coil 110 by the on/off of switching element 80.

Figure 5:
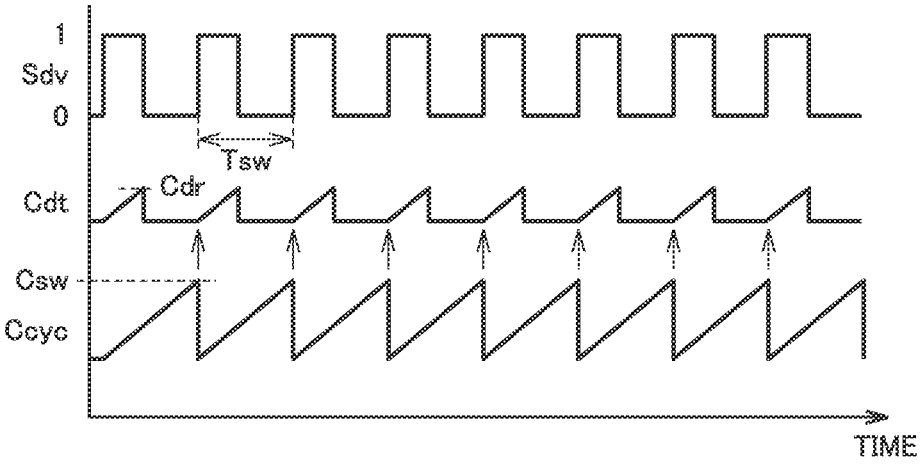
FIG. 5 is a waveform diagram illustrating duty control by the controller.

FIG. 5 shows a waveform diagram for explaining the duty control.

Referring to FIG. 5, CPU 51 counts up count values Ccyc and Cdt every cycle of a clock signal by timer 56.

Count value Ccyc is cleared to zero every time it reaches a count value Csw corresponding to a switching period Tsw of switching element 80. Count value Cdt starts to be counted up at the timing when count value Ccyc is cleared to zero. Further, count value Cdt is cleared to zero when reaching a count value Cdr in accordance with a set duty ratio DT. As described later, duty ratio DT is set within a range of $0 \leq DT \leq 1.0$, and count value Cdr is obtained by $Cdr = DT \cdot Csw$.

Control signal Sdv makes a transition from "0" to "1" at the timing when count value Ccyc is cleared to zero. Further, control signal Sdv makes a transition from "1" to "0" at the timing when count value Cdt is cleared to zero and is kept at "0" until the next timing when count value Ccyc is cleared to zero.

As a result, control signal Sdv makes a transition from "0" to "1" every switching period Tsw, and the ratio of the period of Sdv="1" to switching period Tsw can be set in accordance with duty ratio DT. When DT=1.0, control signal Sdv is kept at "1", and when DT=0, control signal Sdv is kept at "0".

D/A converter 54 shown in FIG. 4 outputs control signal Sdv as a voltage pulse signal set to a logical low level (hereinafter simply referred to as "L level") in a period of Sdv="0" and set to a logical high level (hereinafter simply referred to as "H level") in a period of Sdv="1".

Referring to FIG. 1 again, driver 60 drives a voltage at the control electrode (gate voltage) of switching element 80 in accordance with control signal Sdv output from controller 50 (D/A converter 54). Switching element 80 is thus controlled to turn on in a H level period of control signal Sdv and turn off in a L level period. Therefore, the on/off of switching element 80 is controlled in accordance with switching period Tsw in FIG. 5, and the ratio of the on period to switching period Tsw is controlled in accordance with duty ratio DT. Average current (corresponding to the mean value of coil current Ic) supplied to coil 110 by input voltage Vin thus can be controlled by duty ratio DT.

In the coil drive device of the electromagnetic contactor according to the first embodiment, the magnitude of coil current Ic is controlled by duty control of switching element 80 based on the magnitude of input voltage Vin.

Figure 6:
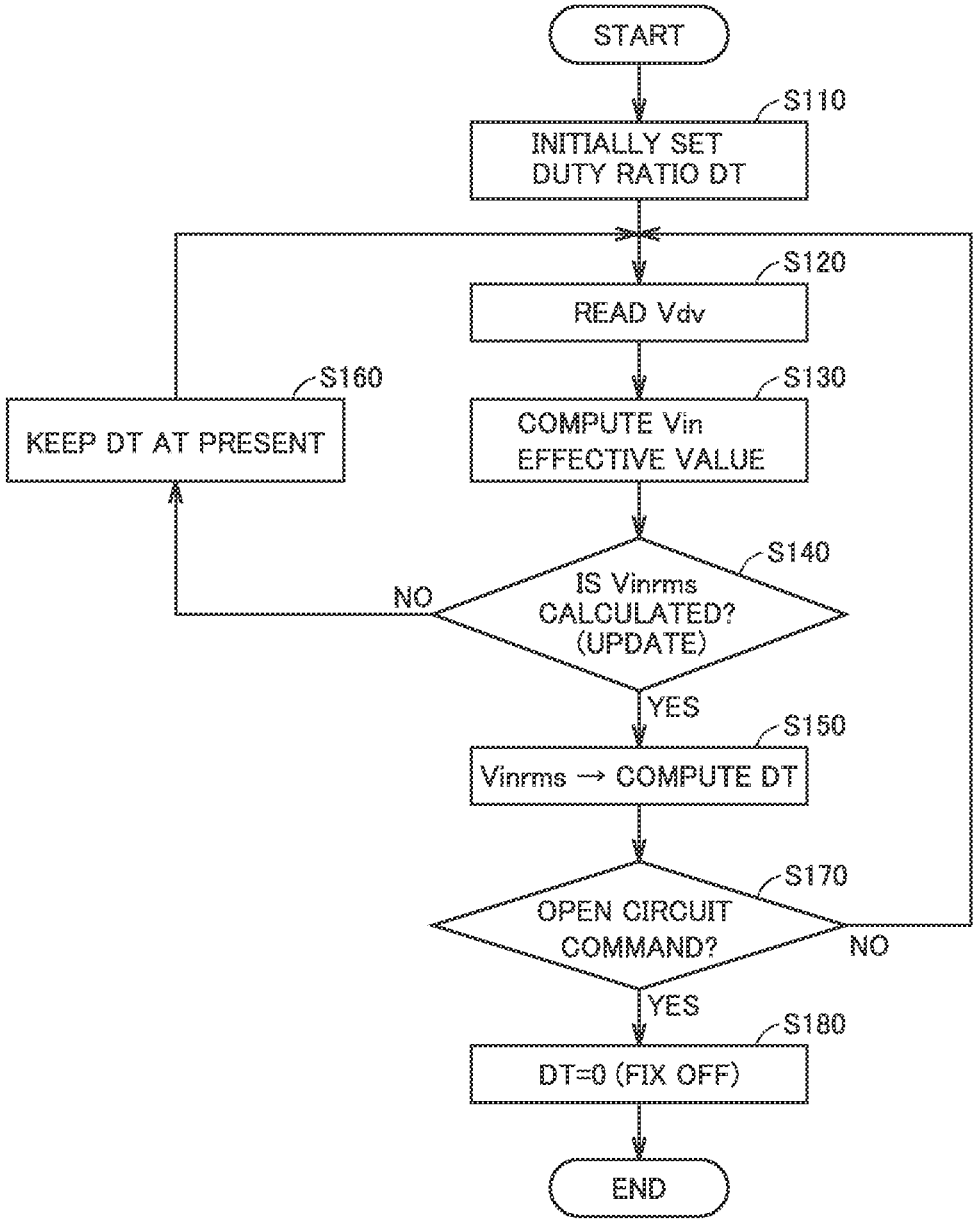
FIG. 6 is a flowchart illustrating a process related to setting of a duty ratio in duty control of a switching element shown in FIG. 2.

FIG. 6 is a flowchart illustrating a process related to setting of a duty ratio in duty control of switching element 80. The process shown in FIG. 6 is started when a close circuit command to bring electromagnetic contactor 200 into the closed state is input to controller 50.

At step (hereinafter simply denoted as "S") 110, controller 50 sets an initial value of duty ratio DT. For example, DT=0 can be initially set. Further, at S120 to S150, controller 50 controls duty ratio DT in accordance with a parameter value indicating the magnitude of input voltage Vin so that coil current Ic does not become excessively large. Here, the effective value (Vinrms) of input voltage Vin is used as the parameter. Input voltage effective value Vinrms is equivalent to the effective value of AC voltage Vac from main power source 10. In an example described below, input voltage effective value Vinrms corresponds to an embodiment of "first parameter" but, for example, the mean value or the maximum value may be "first parameter" instead of the effective value.

Controller 50 samples divided voltage Vdv at S120 and performs effective value computation of input voltage Vin obtained from the sampling voltage at S130. For example, input voltage effective value Vinrms can be calculated by extracting the maximum value of the sampling values (after Vin conversion) corresponding to half a cycle of AC voltage Vac and multiplying the maximum value by ($\sqrt{2}/2$). In doing so, in order to remove noise in the sampling voltage, the maximum value may be extracted from the sampling voltage (for a half cycle) passed through a lowpass filter.

Alternatively, at S130, the effective value may be calculated by computing the mean-square value of the sampling voltage (after Vin conversion). However, the effective value computation based on the maximum value extraction as described above can alleviate the operation load of CPU 51 and increase the calculation speed for the effective value.

If input voltage effective value Vinrms is calculated (the determination is YES at S140), at S150, controller 50 computes duty ratio DT according to the following equation (1) using a predetermined reference voltage Vr and the calculated input voltage effective value Vinrms. When Vr≥Vinrmas, DT=1.0 (maximum value) is set.

$$DT=Vr/Vinrms \quad (1)$$

In equation (1), for example, reference voltage Vr can be set to the nominal value (for example, 100 [V]) of the effective value of input voltage Vin corresponding to the nominal value (for example, effective value 100 [V]) of AC voltage Vac from main power source 10. Reference voltage Vr corresponds to "reference value of the first parameter". Equation (1) is only an example, and the duty ratio can be set as desired as long as coil current Ic can be suppressed by setting duty ratio DT lower when Vinrms>Vr than when Vinrms≤Vr.

The process at S120 to S140 is repeatedly performed every sampling at S120. At S140, an initial value of input voltage effective value Vinrms can be calculated using the sampling value (after Vin conversion) at least for a half cycle of input voltage Vac after the start of reading Vdv at S120. Subsequently, input voltage effective value Vinrms can be updated using the sampling value (after Vin conversion) a half cycle before, every time the half cycle elapses or multiple times in each subsequent half cycle. The determination at S140 is YES at the time of initial calculation of input voltage effective value Vinrms and at the timing of each subsequent update.

In a period until the initial calculation of input voltage effective value Vinrms and in a period other than each subsequent update timing, the determination at S140 is NO, and controller 50 keeps duty ratio DT at present at S160 and repeats the process of calculating input voltage effective value Vinrms at S120 to S140 in constant cycles as described above. As a result, duty ratio DT is adjusted to a value in accordance with the latest input voltage effective value Vinrms every time input voltage effective value Vinrms is calculated (updated).

Controller 50 continues the process at S120 to S150 to supply coil current Ic to coil 110 in accordance with duty ratio DT until an open circuit command for electromagnetic contactor 200 is input (the determination at S170 is NO). Generation of an electromagnetic force in accordance with coil current Ic keeps electromagnetic contactor 200 in the closed state.

On the other hand, if an open circuit command for electromagnetic contactor 200 is input (the determination at S170 is YES), controller 50 sets duty ratio DT=0 at S180. Thus, control signal Sdv is kept at L level and switching element 80 is fixed to the off state. As a result, because of coil current Ic=0, coil 110 does not generate an electromagnetic force, and therefore the biasing force by spring 140 (FIG. 2) opens electromagnetic contactor 200.

Figure 7:
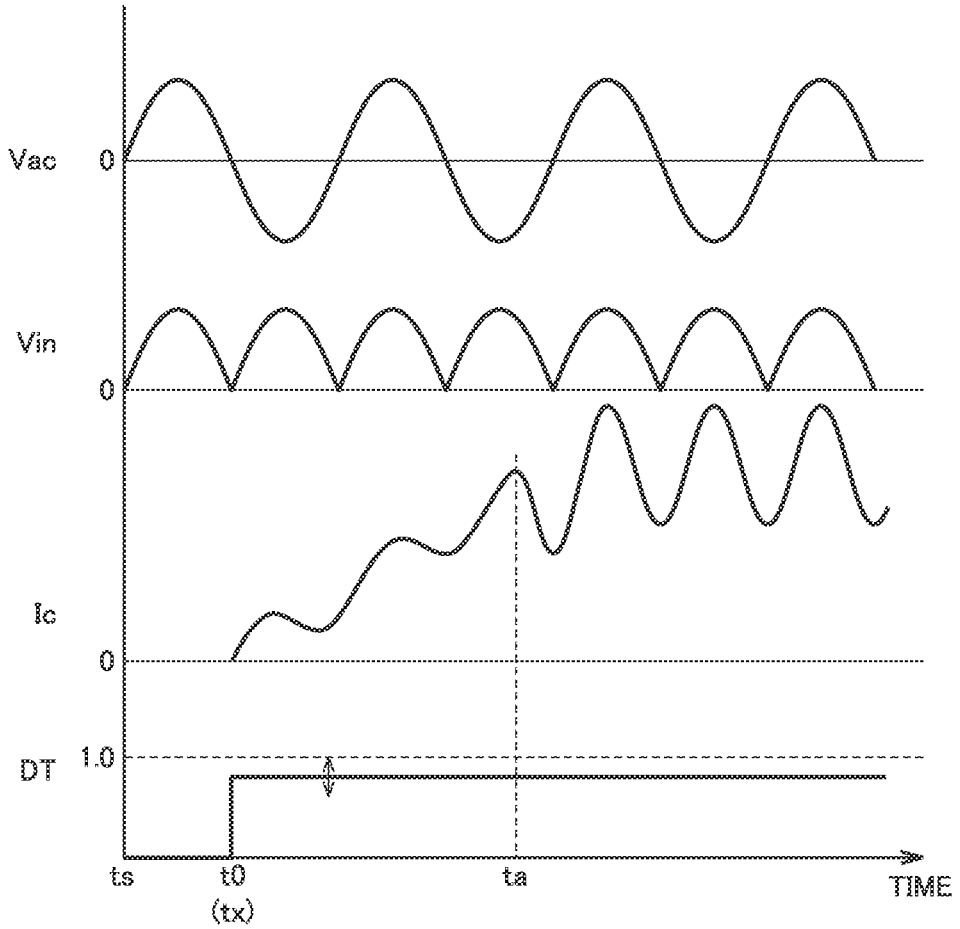
FIG. 7 is a simulation waveform diagram illustrating a first example of close circuit control in accordance with a close circuit command for the electromagnetic contactor.

FIG. 7 is a simulation waveform diagram illustrating a first example of close circuit control in accordance with a close circuit command for electromagnetic contactor 200.

Referring to FIG. 7, at current feed start time ts, operation switch 15 is turned on. Then, input voltage Vin obtained by full-wave rectification of AC voltage Vac from main power source 10 is output from rectifier 20 to power supply line PL. In response, controller 50 is activated by a power supply voltage from control power source 30. Then, the process at S120 to S140 in FIG. 6 is performed.

At time tx, input voltage effective value Vinrms is calculated from input voltage Vin for a half cycle of AC voltage Vac (initial calculation). Until time tx, duty ratio DT is kept at the initial value set at S110 in FIG. 6. As described above, when duty ratio DT=0 is initially set, switching element 80 is kept in the off state until time tx. Accordingly, start time t0 of energization of coil 110 is equivalent to time tx at which input voltage effective value Vinrms is calculated.

At energization start time t0, duty ratio DT is set using the calculated input voltage effective value Vinrms according to the above equation (1). In FIG. 7, an example in which Vinrms>Vr and DT<1.0 is set is shown. After time tx, duty ratio DT can also be changed every time input voltage effective value Vinrms is updated.

After energization start time t0, coil current Ic produces a magnetic flux in fixed core 120 to generate an electromagnetic force that attracts movable core 130 against the biasing force by spring 140. Once movable core 130 starts moving, the coil inductance value of coil 110 decreases with decrease of the gap between fixed core 120 and movable core 130, and coil current Ic increases.

At time ta, fixed core 120 and movable core 130 come into contact with each other to complete the close circuit operation of electromagnetic contactor 200. Thereafter, there is no change in inductance value of coil 110, and coil current Ic increases or decreases in accordance with pulsation of input voltage Vin. The supply of coil current Ic is continued to keep electromagnetic contactor 200 in the closed state.

In the control example in FIG. 7, since coil current Ic can be controlled by duty ratio DT in accordance with input voltage effective value Vinrms from the start of energization, coil current Ic can be suppressed when input voltage Vin is higher than the nominal value. This control can prevent the electromagnetic force generated by coil 110 from becoming excessively large, thereby suppressing the impact when movable core 130 is attracted to fixed core 120 and thus suppressing the influence on the service life of electromagnetic contactor 200.

In the control example in FIG. 7, because of duty ratio DT=0 from the power feed start time ts to time tx at which input voltage effective value Vinrms is calculated, energization of coil 110 is awaited. Therefore, as described above, at S130 in FIG. 6, it is preferable that the time required for calculation of input voltage effective value Vinrms is reduced by the method that multiplies the maximum value extracted from the sampling values (after Vin conversion) for a half cycle of input voltage Vin by (√2/2).

Figure 8:
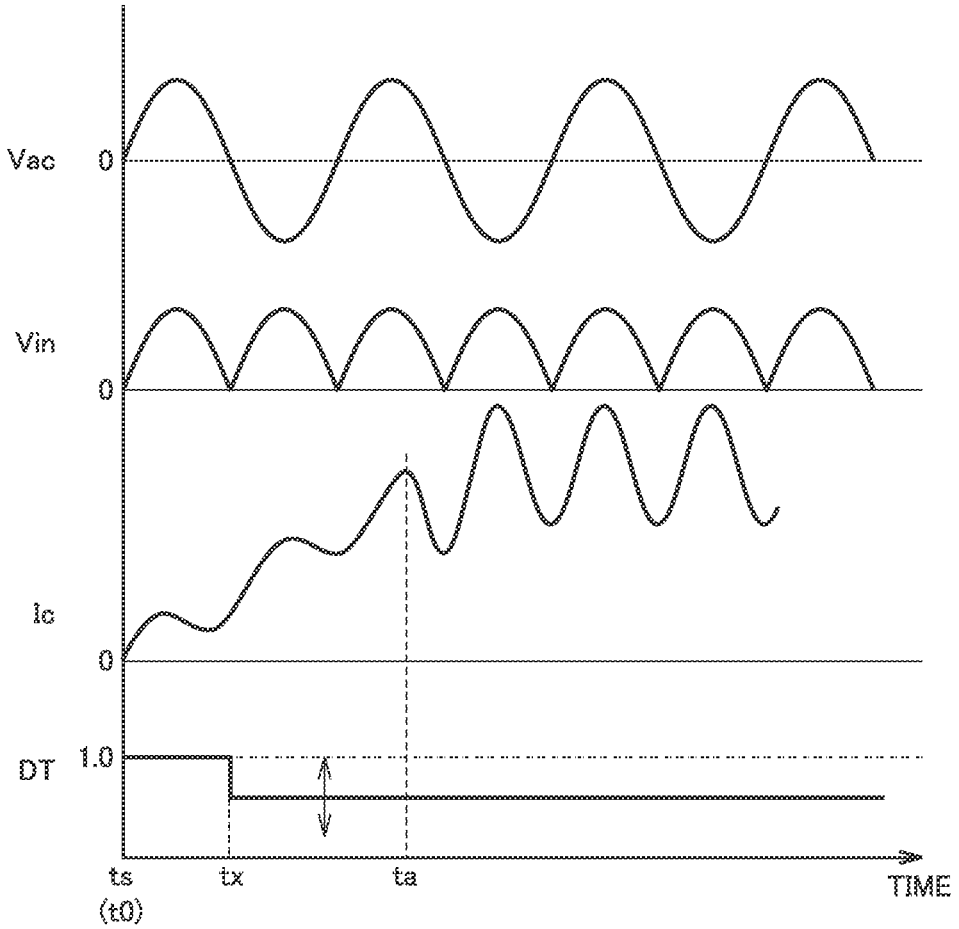
FIG. 8 is a simulation waveform diagram illustrating a second example of close circuit control in accordance with a close circuit command for the electromagnetic contactor.

FIG. 8 is a simulation waveform diagram illustrating a second example of close circuit control in accordance with a close circuit command for electromagnetic contactor 200.

Referring to FIG. 8, at power feed start time ts, the supply of input voltage Vin obtained by full-wave rectification of AC voltage Vac is started, and then controller 50 is activated by power supply voltage from control power source 30, in the same manner as in FIG. 7.

In the second example, at S110 in FIG. 6, duty ratio DT>0 is initially set. In the example in FIG. 8, duty ratio DT=1.0 is initially set, and the supply of coil current Ic can be started in response to generation of input voltage Vin with switching element 80 kept in the on state. That is, when DT>0 is initially set, start time t0 of energization of coil 110 can be equivalent to power feed start time is at which operation switch 15 is turned on.

After energization start time t0, the process at S120 to S140 in FIG. 6 is performed concurrently with energization of coil 110 under duty ratio DT=1.0. At time tx, input voltage effective value Vinrms is calculated (initial calculation), and then after time tx, duty ratio DT is set according to the above equation (1) using the calculated input voltage effective value Vinrms. When Vinrms>Vr, as indicated by the example in FIG. 8, duty ratio DT decreases at time tx.

After time tx, duty ratio DT also changes every time input voltage effective value Vinrms is updated.

In the example in FIG. 8, after time tx, electromagnetic contactor 200 is closed at time ta, in the same manner as in FIG. 7. Therefore, since duty ratio DT is set in accordance with input voltage effective value Vinrms at time ta, the impact of movable core 130 attracted to fixed core 120 due to excessive coil current Ic can be suppressed even when input voltage Vin is higher than the nominal value.

In the example in FIG. 8, when the required time from start time t0 of energization of coil 110 to time ta at which electromagnetic contactor 200 is closed is shorter than the time (time t0 to tx) required for computation of input voltage effective value Vinrms, duty control can be performed in accordance with input voltage effective value Vinrms without extending the required time from input of a close command to controller 50 to time ta at which electromagnetic contactor 200 is closed. By doing so, the control of suppressing excessive coil current in the closed circuit of electromagnetic contactor 200 can be performed without influencing the entire sequence in a system including electromagnetic contactor 200 (for example, elevator cage control system).

By comparison, when the required time from start time t0 of energization of coil 110 to when electromagnetic contactor 200 is closed (time ta) is relatively short, it is preferable that energization of coil 110 is started with duty control after calculation of input voltage effective value Vinrms (after time tx), in the same manner as the control example in FIG. 7, in terms of suppressing excessive coil current reliably.

In this way, in the electromagnetic contactor according to the first embodiment, even when AC voltage Vac is higher than the nominal value, excessive coil current in the close circuit control can be suppressed by duty control using input voltage Vin sampled after the start of power-on. Thus, excessive coil current during close circuit control can be suppressed by simple control computation, rather than complicated and high-load control computation like the control of locus of coil current Ic after the start of energization as described in PTL 1. As a result, the control described above can be implemented using a relatively simple microcontroller without requiring high specifications, leading to lower cost of the coil drive device of the electromagnetic contactor.

Further, in the electromagnetic contactor according to the first embodiment, the closed circuit holding control after the close circuit control can also be performed by a simple control process.

Figure 9:
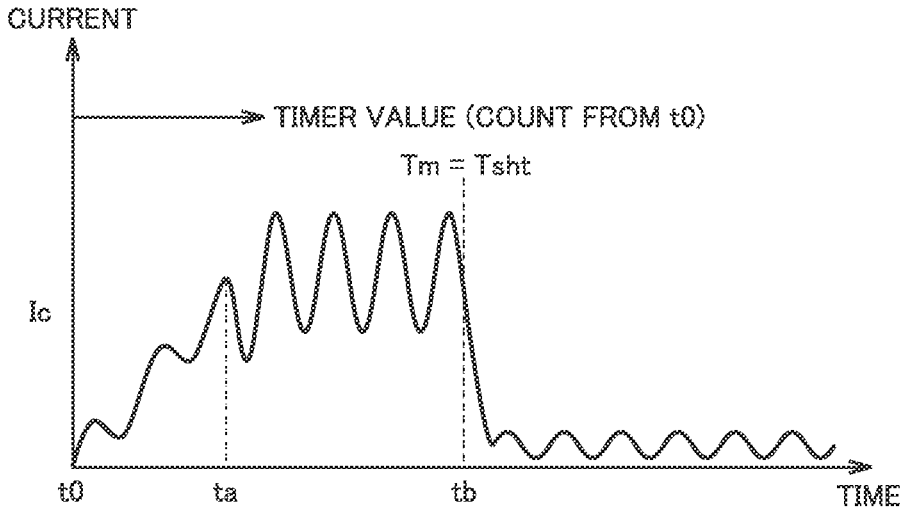
FIG. 9 is a conceptual waveform diagram for explaining closed circuit holding control by the coil drive device of the electromagnetic contactor according to the present embodiment.

FIG. 9 is a conceptual waveform diagram for explaining the closed circuit holding control by the coil drive device of the electromagnetic contactor according to the first embodiment.

Referring to FIG. 9, when electromagnetic contactor 200 is closed at time ta after energization start time t0, after time ta, it is necessary to generate an electromagnetic force for keeping movable core 130 attracted to fixed core 120 against the biasing force of spring 140, as described above. However, after time ta (closed state), there is almost no gap between fixed core 120 and movable core 130, and therefore the generated electromagnetic force with respect to coil current Ic increases. On the other hand, before time ta, although an electromagnetic force to move movable core 130 needs to be generated by coil 110, the generated electromagnetic force with respect to coil current Ic is relatively small compared with after time ta described above because there is a gap between fixed core 120 and movable core 130. Thus, current supplied to coil 110 after time ta can be reduced compared with the value before time ta.

Therefore, in the closed circuit holding control, compared with the close circuit control until time ta, power consumption by coil current Ic can be suppressed by further reducing duty ratio DT. For example, a timer value Tm counted from energization start time t0 is compared with a predetermined determination value Tsht, and after time tb in which Tm≥Tsht, the closed circuit holding control to reduce coil current Ic can be performed.

Figure 10:
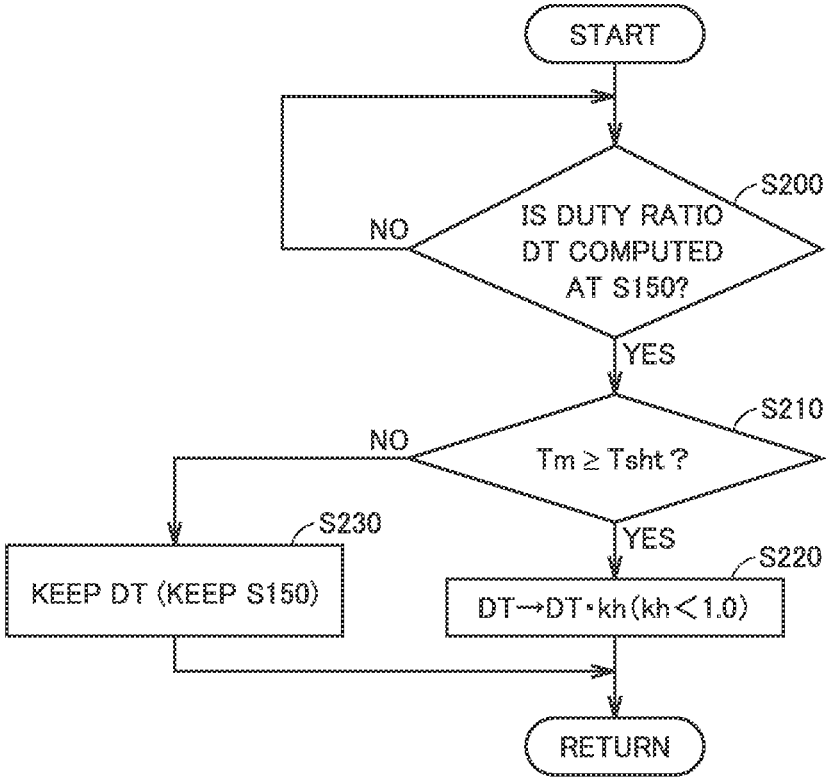
FIG. 10 is a flowchart illustrating a control process example for performing closed circuit holding control shown in FIG. 9.

FIG. 10 is a flowchart illustrating a control process example for performing the closed circuit holding control shown in FIG. 9.

Referring to FIG. 10, if duty ratio DT is calculated at S150, the determination at S200 is YES, and controller 50 performs the process after S210 to perform the closed circuit holding control.

At S210, controller 50 compares timer value Tm at present with determination value Tsht. Determination value Tsht can be preset, based on an actual device test or the like, by converting a time length obtained by giving a margin to the actual value of the required time from the start of coil energization to when electromagnetic contactor 200 is closed (time length from time t0 to ta), into a timer value.

When Tm≥Tht (the determination is YES at S210), controller 50 performs the closed circuit holding control at S220. Specifically, the value obtained by multiplying the calculation value (DT=Vr/Vinrms) at S150 by a control coefficient kh is set as duty ratio DT in the closed circuit holding control. Control coefficient kh is less than 1.0 and can be set to, for example, about 0.3 or can be preset in an actual device test or the like in consideration of the arrangement situation of electromagnetic contactor 200 (for example, the presence or absence of external vibration). In the closed circuit holding control, the maximum value of duty ratio DT is also kh.

On the other hand, in a period of Tm<Tht (the determination at S210 is NO), controller 50 proceeds to S230 without applying the closed circuit holding control. At S230, duty ratio DT calculated at S150 is kept.

As a result, as shown in FIG. 9, after time tb when a predetermined time corresponding to determination value Tsht has elapsed since start time t0 of energization of coil 110, coil current Ic can be suppressed by the closed circuit holding control. As a result, power consumption for keeping electromagnetic contactor 200 in the closed state can be reduced by a simple control process based on the timer value.

Second Embodiment

There are individual differences in inductance value and resistance value among coils 110 due to variations in production. Because of such individual differences, coil current Ic may also vary for the same duty ratio DT. In a second embodiment, duty control that reflects individual differences of coil 110 will be described.

Figure 11:
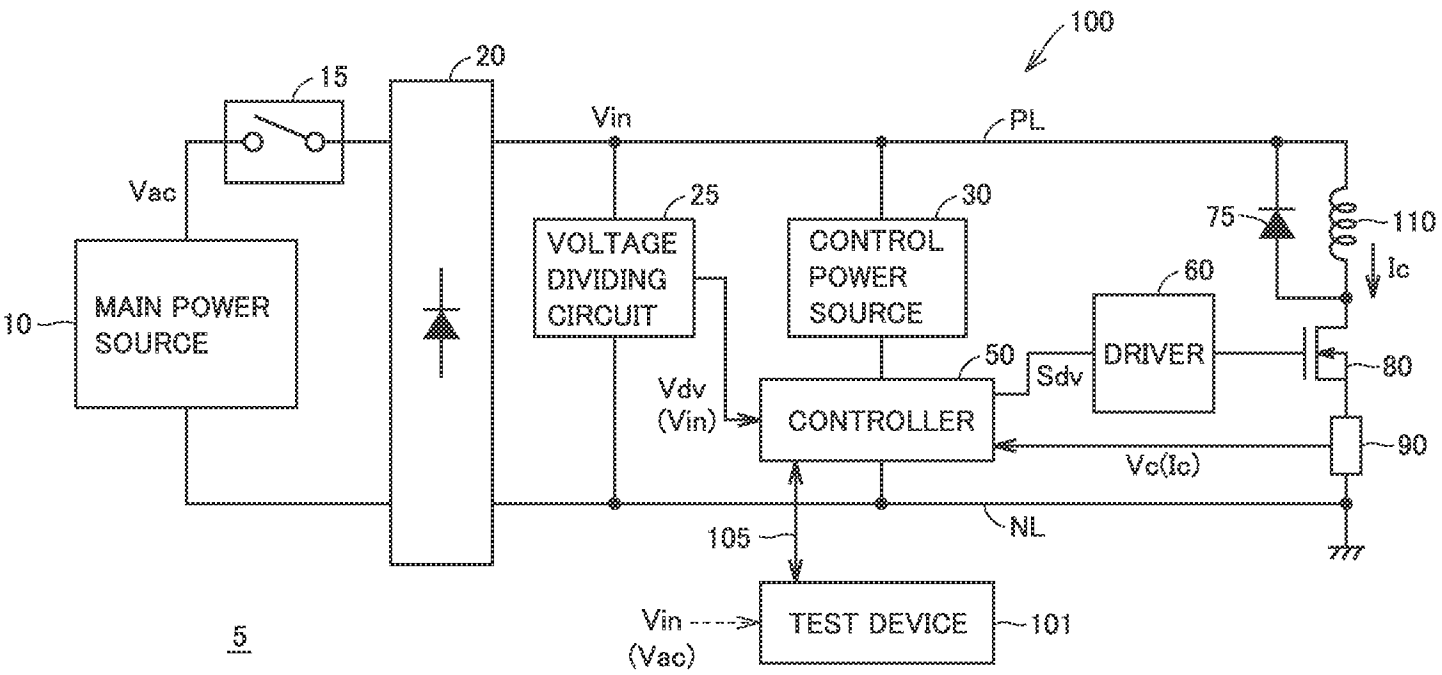
FIG. 11 is a block diagram illustrating a configuration of the coil drive device of the electromagnetic contactor according to a second embodiment.

FIG. 11 is a block diagram illustrating a configuration of the coil drive device of the electromagnetic contactor according to the second embodiment.

Referring to FIG. 11, coil drive device 100 of the electromagnetic contactor according to the second embodiment is configured to communicate with a test device 101. Specifically, controller 50 exchanges data with test device 101 using communication unit 57 (FIG. 4) through a communication channel 105 via wired communication or wireless communication. Test device 101 can be configured with, for example, a computer (for example, personal computer) that can execute a program stored in advance.

Specifically, controller 50 transmits the locus of coil current Ic obtained from the detected voltage by current detector 90, that is, coil current data Dic that is a combination of the time after the start of energization and a current value (Ic), to test device 101.

Test device 101 calculates an adjustment coefficient kc for individual differences of coil 110, using AC voltage Vac or input voltage Vin and coil current data DIc.

Figure 12:
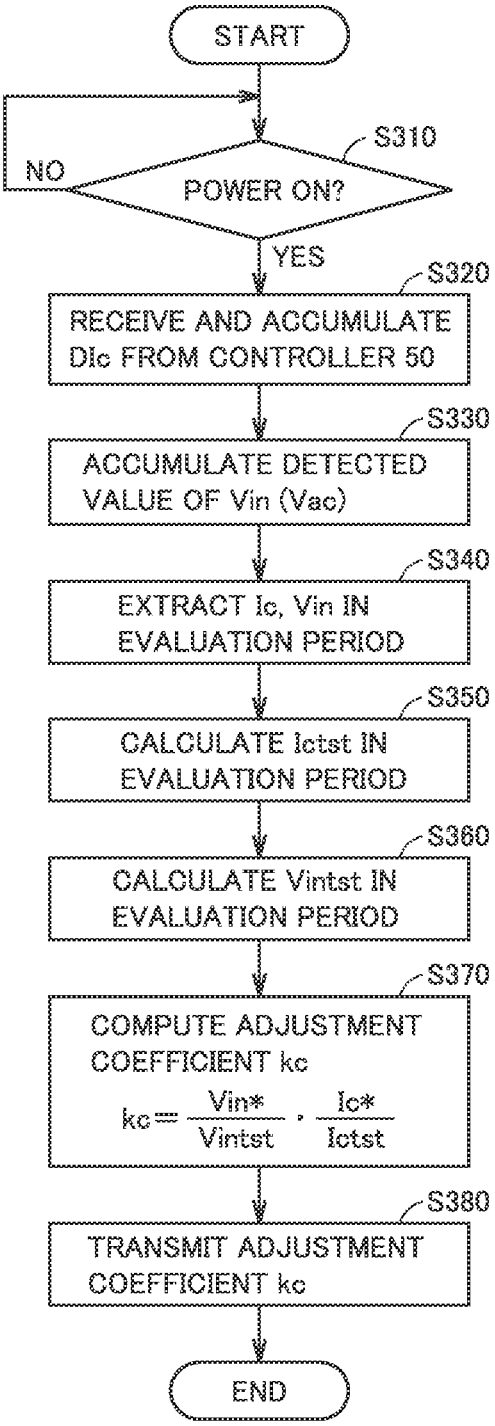
FIG. 12 is a flowchart illustrating a calculation process for an adjustment coefficient by a test device shown in FIG. 11.

FIG. 12 is a flowchart illustrating a calculation process for adjustment coefficient kc by test device 101. The process in FIG. 12 is performed, for example, in a test step of coil drive device 100.

Referring to FIG. 12, if operation switch 15 turns on to turn the power on (the determination at S310 is YES), test device 101 starts the process after S320.

Test device 101 receives and accumulates coil current data DIc from controller 50 at S320 and accumulates the detected value of input voltage Vin (or AC voltage Vac) at S330.

Further, at S340, test device 101 extracts input voltage Vin and coil current Ic in a predetermined evaluation period from the data accumulated at S320 and S330. For example, the evaluation period can be set as a half cycle or one cycle of AC voltage Vac after time tb in FIG. 9 in order to stably evaluate the inductance value, by way of example. The test period can be set as desired.

At S350, test device 101 calculates a coil current evaluation value Ictst in the evaluation period. For example, coil current evaluation value Ictst can be sets as the mean value of coil current Ic in the evaluation period. Alternatively, coil current evaluation value Ictst can be set by computing the effective value of the AC component of coil current Ic obtained by subtracting the above mean value from coil current Ic in the evaluation period. That is, coil current evaluation value Ictst corresponds to "second parameter".

At S360, test device 101 calculates an input voltage evaluation value Vintst in the evaluation period. For example, the effective value of AC voltage Vac or input voltage Vin in the evaluation period can be computed and set as input voltage evaluation value Vintst. This input voltage evaluation value Vintst corresponds to "first parameter".

Further, at S370, test device 101 calculates adjustment coefficient kc according to the following equation (2), using predetermined input voltage reference characteristic value Vin* and coil current reference characteristic value Ic*, and coil current evaluation value Ictst and input voltage evaluation value Vintst obtained at S350 and S360.

$$kc=(Vin^*/Vintst)\cdot(Ic^*/Ictst) \quad (2)$$

Coil current reference characteristic value Ic* and input voltage reference characteristic value Vin* can be preset based on the actual values of input voltage Vin and coil current Ic in the evaluation period obtained when coil current Ic is supplied by coil drive device 100 to coil 110 having characteristics serving as a reference. Input voltage reference characteristic value Vin* corresponds to "reference characteristic value of the first parameter", and coil current reference characteristic value Ic* corresponds to "reference characteristic value of the second parameter".

Adjustment coefficient kc is set to 1.0 when coil current reference characteristic value Ic* is equal to coil current evaluation value Ictst in the evaluation period. On the other hand, when Ictst>Ic*, kc<1.0 is set in accordance with the ratio between them, and when Ic*>Ictst, kc>1.0 is set in accordance with the ratio between them.

Further, adjustment coefficient kc is corrected in accordance with the ratio between input voltage reference characteristic value Vin* and input voltage evaluation value Vintst in the evaluation period. Specifically, in equation (2), the ratio between the value obtained by multiplying the calculated coil current evaluation value Ictst by (Vintst/Vin*) and coil current reference characteristic value Ic* is determined. Thus, adjustment coefficient kc can be calculated in accordance with the ratio between coil current reference characteristic value Ic* and coil current evaluation value Ictst after the influence of input voltage Vin on coil current evaluation value Ictst is eliminated.

At S380, test device 101 transmits adjustment coefficient kc calculated at S350 to controller 50. Controller 50 stores the transmitted adjustment coefficient kc into memory 52.

Controller 50 computes duty ratio DT according to the following equation (3), further using adjustment coefficient kc stored in memory 52, instead of the above equation (1), at S150 in FIG. 6 described in the first embodiment.

$$DT=kc\cdot(Vr/Vinrms) \quad (3)$$

As a result, in the electromagnetic contactor according to the second embodiment, duty ratio DT is kc times the calculation value in the first embodiment both in the close circuit control and the closed circuit holding control. As a result, differences in coil current Ic dependent on individual differences of coil 110 due to production variations and the like can be suppressed.

As a result, even when the inductance value of coil 110 is small and coil current Ic necessary for closing electromagnetic contactor 200 is larger than a reference, the close circuit control and the closed circuit holding control can be performed as appropriate. On the other hand, even when the inductance value of coil 110 is large and coil current Ic necessary for closing electromagnetic contactor 200 is smaller than a reference, the impact during circuit close and excessive power consumption during closed circuit holding due to excessive coil current Ic can be prevented.

Third Embodiment

In a third embodiment, control for reducing electromagnetic noise caused by the on/off control (duty control) of switching element 80 for controlling coil current Ic will be described.

As described in the first embodiment, control signal Sdv of switching element 80 is generated such that the ratio of the on period of switching element 80 to switching period Tsw is controlled, in accordance with duty ratio DT. Therefore, when switching period Tsw is fixed, switching frequency fsw (fsw=1/Tsw) of switching element 80 is fixed. Accordingly, the intensity of electromagnetic noise at a particular frequency may be increased. For example, when Tsw=100 [μs] is fixed, the intensity of electromagnetic noise at fsw=10 [kHz] may be increased.

In the third embodiment, control of the switching element for suppressing a peak intensity of electromagnetic noise will be described. In the switching control according to the third embodiment, count value Csw corresponding to switching period Tsw shown in FIG. 5 is changed with the elapse of time, thereby preventing the switching frequency from being fixed.

Figure 13:
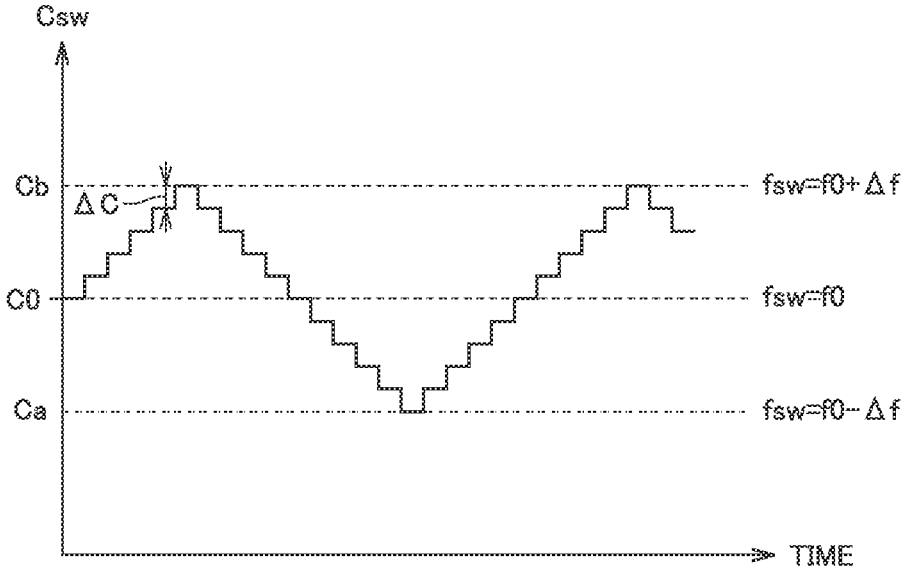
FIG. 13 is a conceptual diagram illustrating an example of switching control according to a third embodiment.

FIG. 13 is a conceptual diagram illustrating an example of switching control according to the third embodiment.

Referring to FIG. 13, count value Csw for a basic switching frequency f0 (for example, f0=10 [kHz]) of switching element 80 is C0.

In the duty control by controller 50 explained with reference to FIG. 5, switching period Tsw (switching frequency f0) can be changed by changing count value Csw by ΔC. For example, it is preferable that switching frequency fsw is gradually changed by limiting the range within $f0-\Delta f0 \leq fsw \leq f0+\Delta f0$ such that the amount of change from switching frequency f0 is within a certain amount.

In this case, count value Csw to be compared with count value Ccyc is changed by ΔC within the limited range around C0 from the minimum value Ca corresponding to the frequency f0−Δf0 to the maximum value Cb corresponding to the frequency f0+Δf0, whereby switching frequency fsw can be gradually changed in the range of $f0-\Delta f0 \leq fsw \leq f0+\Delta f0$. For example, Δf0=1 [kHz] can be set for f0=10 [kHz], and ΔC can be set to a count value to such a degree that the switching frequency changes by 100 [Hz]. In this way, setting the amount of change Δf0 of the switching frequency and the amount of change ΔC0 can prevent change of switching frequency fsw from becoming too large and causing unstable control.

Figure 14:
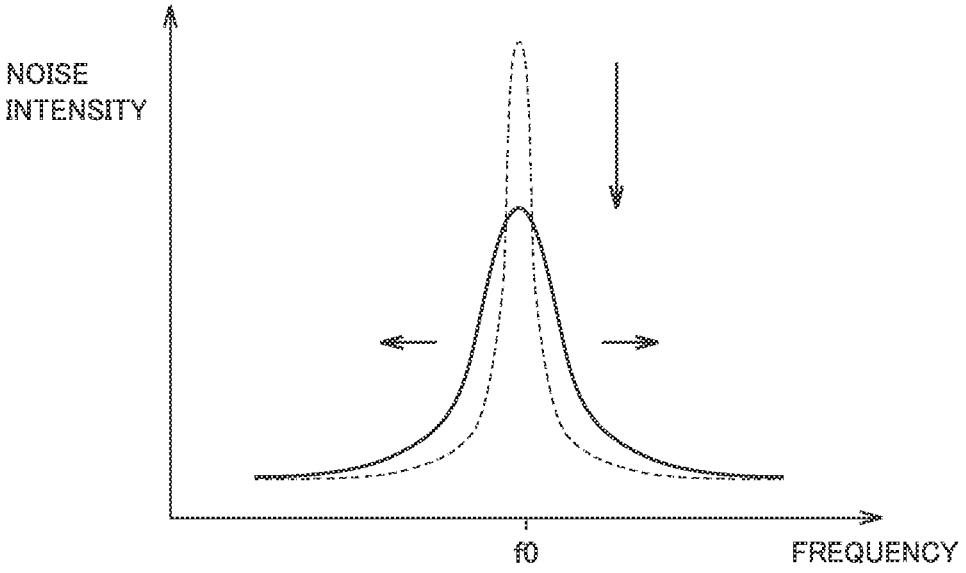
FIG. 14 is a conceptual diagram illustrating a distribution of electromagnetic noise intensity by switching control according to the third embodiment.

FIG. 14 is a conceptual diagram illustrating a distribution of electromagnetic noise intensity by switching control according to the third embodiment.

The dotted line in FIG. 14 depicts a distribution of electromagnetic noise intensity when switching frequency fsw=f0 is fixed. It is understood that the frequency of electromagnetic noise is concentrated on f0 and therefore the intensity of electromagnetic noise at frequency f0 is increased.

By comparison, the solid line in FIG. 14 depicts a distribution of electromagnetic noise intensity when the switching frequency change control shown in FIG. 13 is applied. It is understood that since switching frequency fsw is gradually changed, the frequency region in which electromagnetic noise occurs is widened and consequently, the electromagnetic noise intensity at frequency f0 becomes lower than the dotted line.

In this way, the switching control according to the third embodiment can reduce the peak intensity in the entire frequency region for electromagnetic noise produced by switching element 80. As a result, the coil current control described in the first and second embodiments can be implemented while a margin is ensured for harmonic regulation required for the power supply line.

The manner of change in count value Csw, that is, switching period Tsw shown in FIG. 13 is illustrated by way of example, and the value of count value Csw can be changed in any preferable manner in order to change switching frequency fsw with the elapse of time.

Embodiments disclosed here should be understood as being illustrative rather than being limitative in all respects. The scope of the present invention is shown not in the foregoing description but in the claims, and it is intended that all modifications that come within the meaning and range of equivalence to the claims are embraced here.

REFERENCE SIGNS LIST

10 main power source, 15 operation switch, 20 rectifier, 25 voltage dividing circuit, 30 control power source, 50 controller, 52 memory, 53 A/D converter, 54 D/A converter, 55 internal bus, 56 timer, 57 communication unit, 60 driver, 75 diode, 80 switching element, 90 current detector, 100 coil drive device, 101 test device, 105 communication channel, 110 coil, 120 fixed core, 121 magnetic leg, 130 movable core, 140 spring, 150 fixed terminal, 155 fixed contact, 160 movable terminal, 165 movable contact, 200 electromagnetic contactor, Tcyc, Tdt count value, DIc coil current data, Ic coil current, Ic* coil current reference characteristic value, Ictst coil current evaluation value, NL ground line, PL power supply line, Sdv control signal (switching element), Tm timer value, Tsht determination value, Tsw switching period, Vc detected voltage (current detector), Vdv divided voltage, Vin input voltage, Vin* input voltage reference characteristic value, Vinrms input voltage effective value, Vintst input voltage evaluation value, Vr reference voltage, kc adjustment coefficient, kh control coefficient (energization holding control), t0 energization start time, is power feed start time.

The invention claimed is:

1. An electromagnetic contactor comprising:

a first contact;

a second contact;

a mechanism to generate a biasing force for opening the first and second contacts;

an operation coil to generate an electromagnetic force for bringing the first and second contacts into contact with each other against the biasing force; and a coil drive device to supply current for generating the electromagnetic force to the operation coil, the coil drive device including a rectifier to output, to a power supply line, an input voltage obtained by full-wave rectification of an AC voltage supplied from an AC power source, a switching element connected to the power supply line in series with the operation coil, a voltage detector to detect the input voltage, and a controller to control on and off of the switching element, wherein the controller controls on and off of the switching element so as to control a duty ratio that is a ratio of an on period of the switching element in a switching period shorter than one cycle of the AC voltage, and controls the duty ratio in accordance with a value of a first parameter indicating a magnitude of the input voltage that is calculated using a detected value of the voltage detector, in at least a partial period after start of energization of the operation coil in response to a close command for the electromagnetic contactor, and when a calculation value of the first parameter is larger than a predetermined reference value, the duty ratio is set to a value lower than when the calculation value is equal to or smaller than the reference value, wherein the reference value is set to a value of the first parameter corresponding to a nominal value of the AC voltage, and when the calculation value of the first parameter is larger than the reference value, the controller sets the duty ratio in accordance with a value obtained by dividing the reference value by the calculation value.

2. An electromagnetic contactor comprising:

a first contact;

a second contact;

a mechanism to generate a biasing force for opening the first and second contacts;

an operation coil to generate an electromagnetic force for bringing the first and second contacts into contact with each other against the biasing force; and a coil drive device to supply current for generating the electromagnetic force to the operation coil, the coil drive device including a rectifier to output, to a power supply line, an input voltage obtained by full-wave rectification of an AC voltage supplied from an AC power source, a switching element connected to the power supply line in series with the operation coil, a voltage detector to detect the input voltage, and a controller to control on and off of the switching element, wherein the controller controls on and off of the switching element so as to control a duty ratio that is a ratio of an on period of the switching element in a switching period shorter than one cycle of the AC voltage, and controls the duty ratio in accordance with a value of a first parameter indicating a magnitude of the input voltage that is calculated using a detected value of the voltage detector, in at least a partial period after start of energization of the operation coil in response to a close command for the electromagnetic contactor, and when a calculation value of the first parameter is larger than a predetermined reference value, the duty ratio is set to a value lower than when the calculation value is equal to or smaller than the reference value, wherein the controller determines the duty ratio of the switching element by multiplying an adjustment coefficient that reflects individual differences of the operation coil.

3. The electromagnetic contactor according to claim 2, wherein the reference value is set to a value of the first parameter corresponding to a nominal value of the AC voltage, and when the calculation value of the first parameter is larger than the reference value, the controller sets the duty ratio in accordance with a value obtained by dividing the reference value by the calculation value.

4. The electromagnetic contactor according to claim 3, wherein when the calculation value is equal to or smaller than the reference value, the controller sets the duty ratio to 1.

5. The electromagnetic contactor according to claim 1, wherein when the calculation value is equal to or smaller than the reference value, the controller sets the duty ratio to 1.

6. The electromagnetic contactor according to claim 1, wherein the controller determines the duty ratio of the switching element by multiplying an adjustment coefficient that reflects individual differences of the operation coil.

7. The electromagnetic contactor according to claim 1, further comprising a current detector to detect coil current flowing through the operation coil, wherein the adjustment coefficient is calculated using a value of a second parameter indicating a magnitude of the coil current that is calculated using a detected value of the current detector during energization of the operation coil, a value of the first parameter calculated using the detected value of the voltage detector during the energization, and reference characteristic values of the first and second parameters obtained in advance during energization of the operation coil having characteristics serving as a reference.

8. The electromagnetic contactor according to claim 1, wherein the controller sets the duty ratio to 0 at start of supply of the AC voltage to the rectifier to await energization of the operation coil, performs calculation of the first parameter using the detected value of the voltage detector, and after acquiring a calculation value of the first parameter, starts energization of the operation coil with control of the duty ratio in accordance with the calculation value.

9. The electromagnetic contactor according to claim 1, wherein the controller sets the duty ratio larger than 0 from start of supply of the AC voltage to the rectifier to start energization of the operation coil, performs calculation of the first parameter using the detected value of the voltage detector, and after acquiring a calculation value of the first parameter, controls the duty ratio in accordance with the calculation value.

10. The electromagnetic contactor according to claim 1, wherein when a predetermined determination time has elapsed since start of energization of the operation coil, the controller sets the duty ratio lower than before elapse of the determination time, and the determination time is set to be longer than a required time from the start of energization to when the electromagnetic contactor is brought into a closed state by contact between the first and second contacts.

11. The electromagnetic contactor according to claim 1, wherein the first parameter is an effective value, and the controller extracts a maximum value of the detected value of the input voltage by the voltage detector in a period equal to or longer than a half cycle of the AC voltage and calculates the effective value by multiplying the maximum value by a predetermined coefficient.

12. The electromagnetic contactor according to claim 1, wherein the controller changes the switching period of the switching element with elapse of time, in control of the duty ratio.

* * * * *